US007661940B2

(12) United States Patent
Maeng

(10) Patent No.: US 7,661,940 B2
(45) Date of Patent: Feb. 16, 2010

(54) ROTOR ECCENTRICALLY INSTALLED IN A CYLINDER OF A ROTARY ENGINE OR COMPRESSOR

(76) Inventor: Hyuk-Jae Maeng, 203-1003 Keukdong Apt., Baickma Maeul, #793, Madoo-dong, Ilsan-gu, Goyang-shi, Kyungki-do 410-708 (KR)

( * ) Notice: Subject to any disclaimer, the term of this patent is extended or adjusted under 35 U.S.C. 154(b) by 0 days.

(21) Appl. No.: 12/086,719

(22) PCT Filed: Mar. 14, 2006

(86) PCT No.: PCT/KR2006/000917

§ 371 (c)(1),
(2), (4) Date: Jun. 17, 2008

(87) PCT Pub. No.: WO2007/081070

PCT Pub. Date: Jul. 19, 2007

(65) Prior Publication Data

US 2009/0028738 A1 Jan. 29, 2009

(30) Foreign Application Priority Data

Jan. 16, 2006 (KR) ..... 10-2006-0004359

(51) Int. Cl.
*F03C 4/00* (2006.01)
*F04C 18/00* (2006.01)

(52) U.S. Cl. ..... 418/258; 418/122; 418/146; 418/253; 418/255

(58) Field of Classification Search ..... 418/253–255, 418/257, 258, 259, 266–268, 112, 143–146
See application file for complete search history.

(56) References Cited

U.S. PATENT DOCUMENTS 3,437,079 A * 4/1969 Odawara ..... 418/111

(Continued)

FOREIGN PATENT DOCUMENTS

JP 59168292 9/1984

(Continued)

OTHER PUBLICATIONS

English-language abstract of Japanese Patent Publication No. JP 2004-285978 published Oct. 14, 2004, esp@cenet database.

(Continued)

*Primary Examiner*—Theresa Trieu
(74) *Attorney, Agent, or Firm*—Cooper & Dunham LLP

(57) ABSTRACT

A rotor for rotary engines and compressors is disclosed. The rotor of the present invention includes a first body unit (100*a*), which has a rotor housing (102) and a core (104) provided with a plurality of roller plate seats. The rotor further includes a second body unit (100*b*) having a structure symmetrical with the first body unit, a roller support plate (40), which is placed on each of the roller plate seats, a roller cage (42), which is provided on each of the roller support plates and has a pin roller receiving space therein, and a plurality of pin rollers (46), which are placed in the pin roller receiving space of the roller cage to ensure smooth reciprocation of the sliding vane. The rotor further includes the sliding vane (30), which is provided between the first body unit and the second body unit and reciprocates in a diametrical direction, and a spacer (106), which maintains a constant distance between the first body unit and the second body unit.

4 Claims, 8 Drawing Sheets

U.S. PATENT DOCUMENTS 4,155,685 A * 5/1979 Kunieda et al. ..... 418/112
4,515,123 A 5/1985 Taylor
6,866,491 B2 * 3/2005 Maeng ..... 418/258

FOREIGN PATENT DOCUMENTS

JP 2004-285978 10/2004
KR 20060099564 A * 9/2006

OTHER PUBLICATIONS

English-language abstract of Japanese Patent Publication No. JP 2004 332697, published Nov. 25, 2004, esp@cenet database.
English-language abstract of Japanese Patent Publication No. JP 59-168292, published Sep. 21, 1984, esp@cenet database.

* cited by examiner

【Fig. 1】
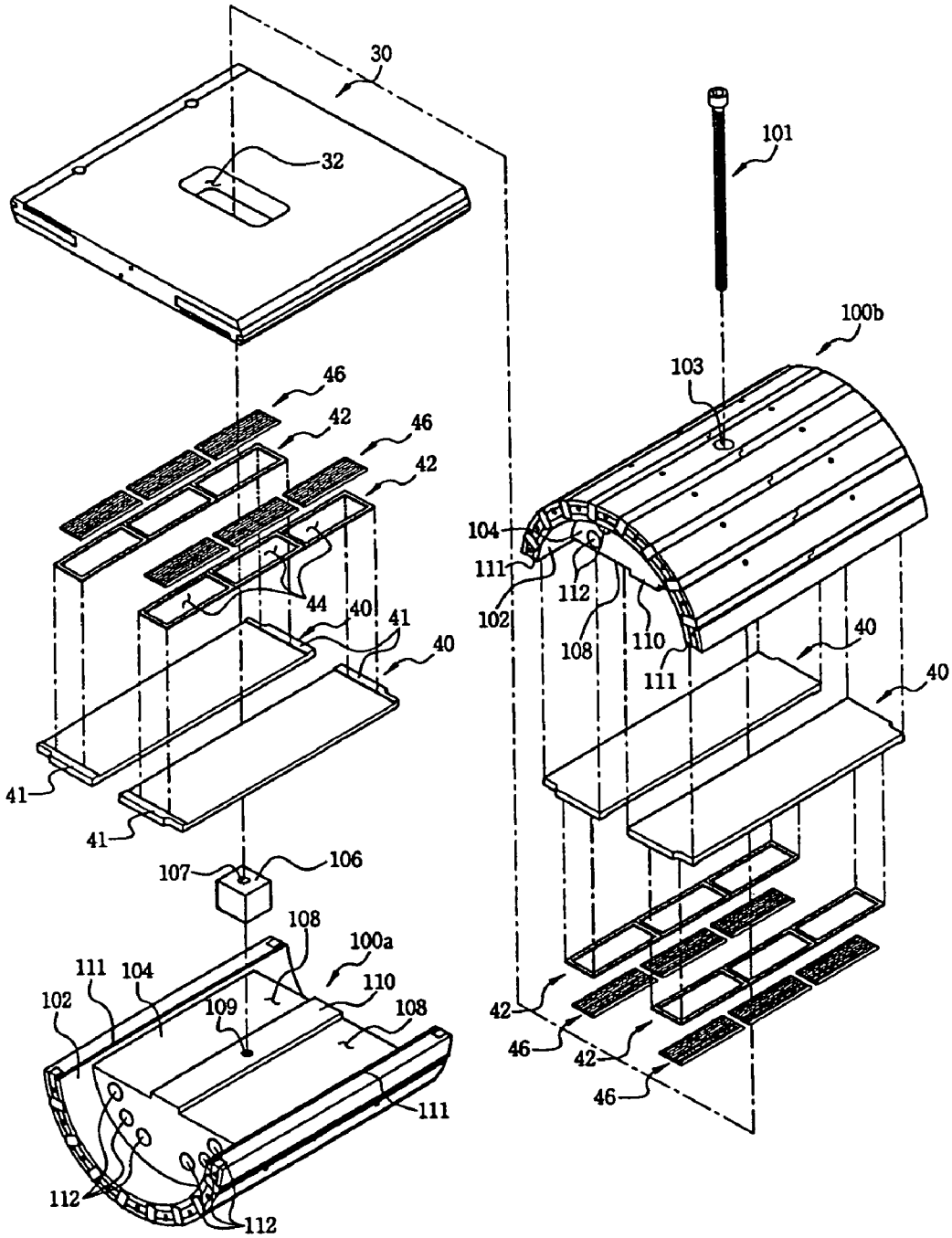

【Fig. 2】
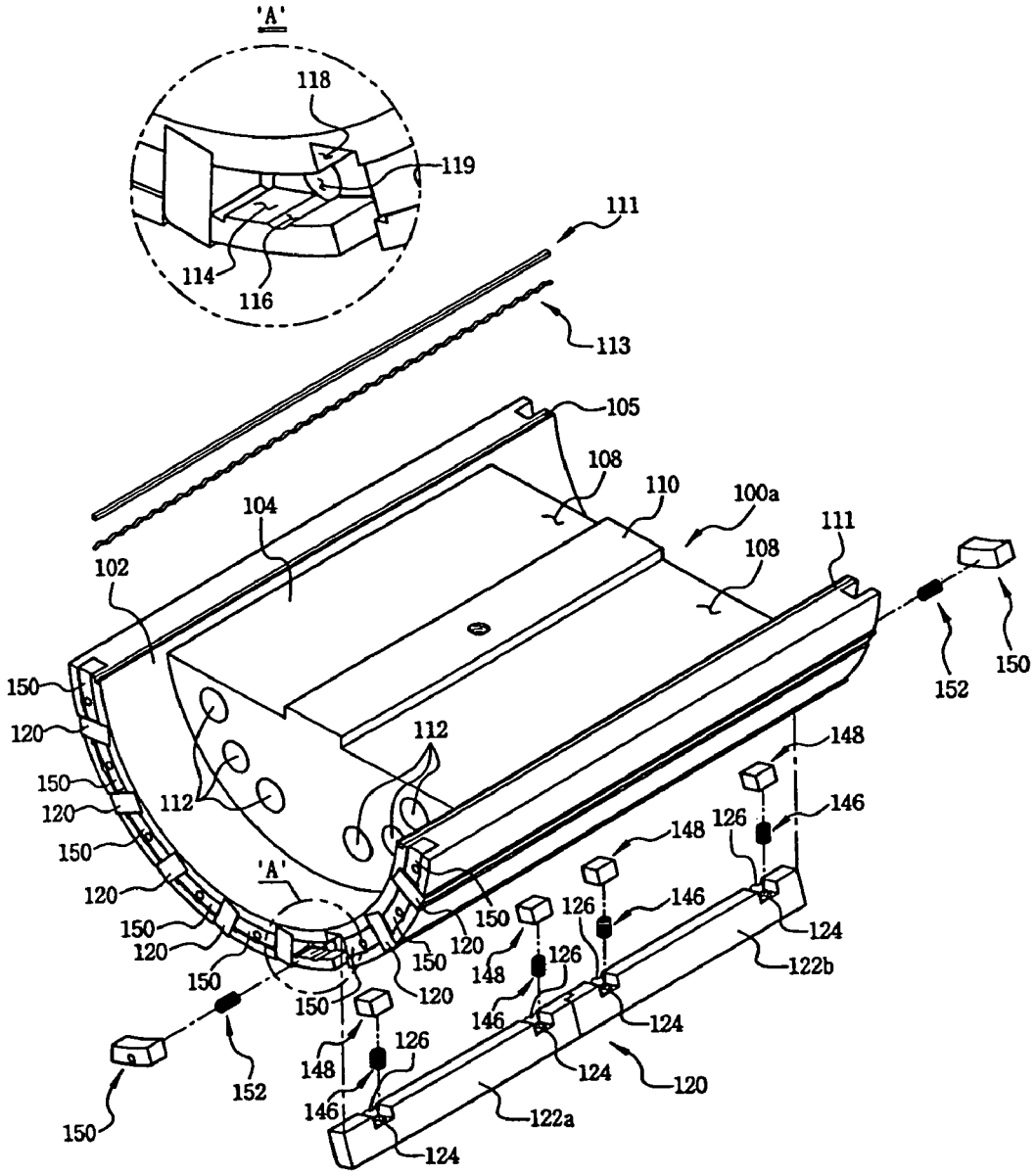

【Fig. 3】
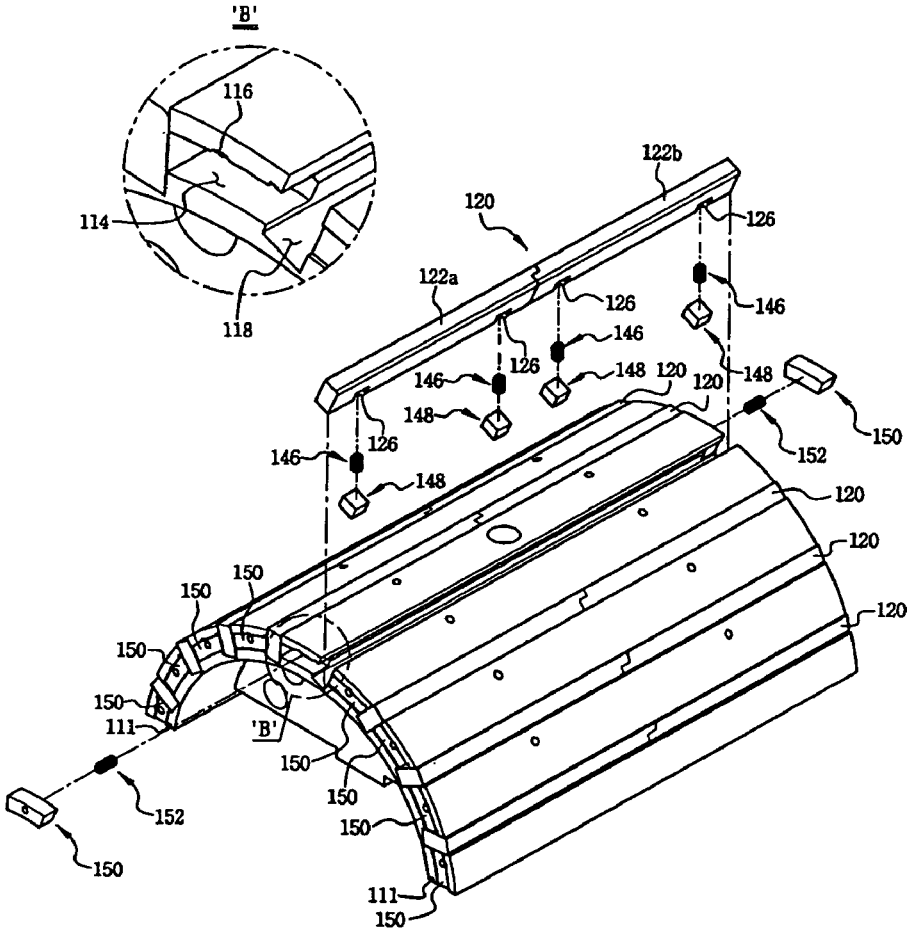
【Fig. 4】
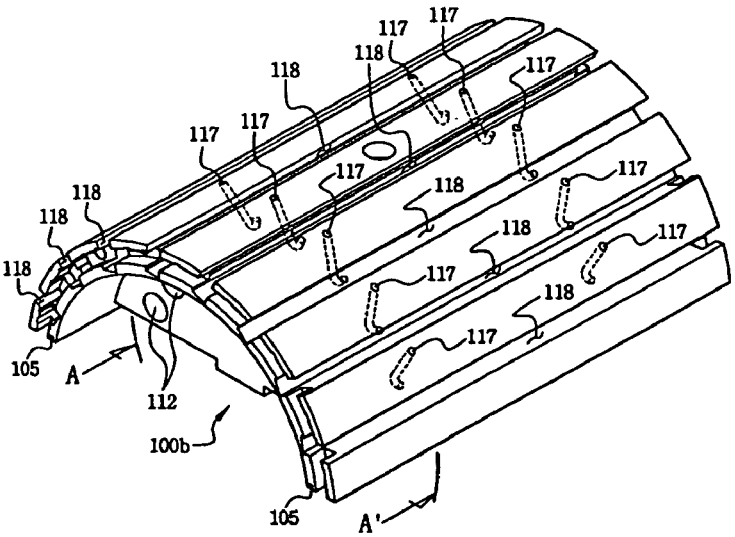

【Fig. 5】
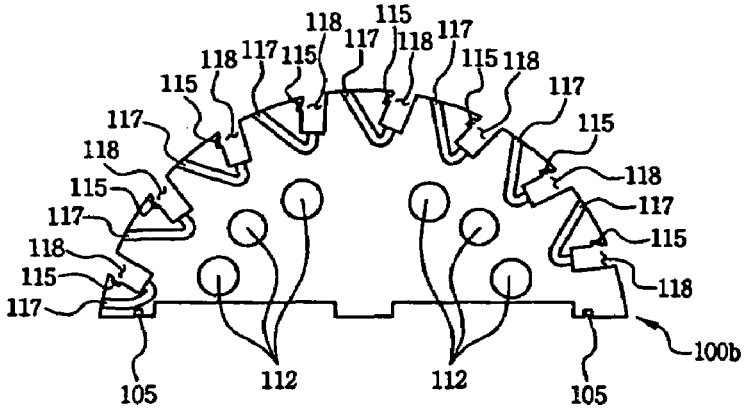
118
115
117
118
117
115
117
118
115
118
115
117
118
117
115
117
118
115
117
118
115
117
118

【Fig. 9】
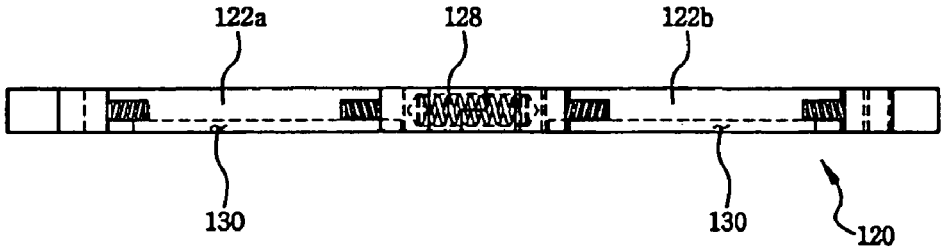
【Fig. 10】
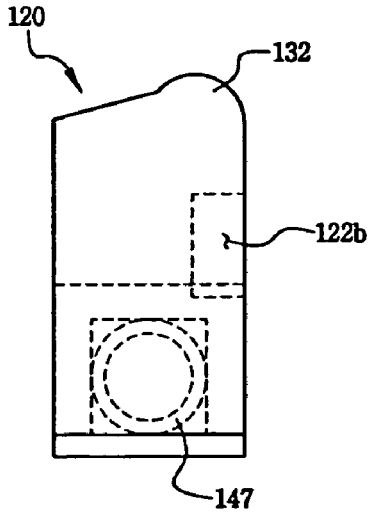
【Fig. 11】
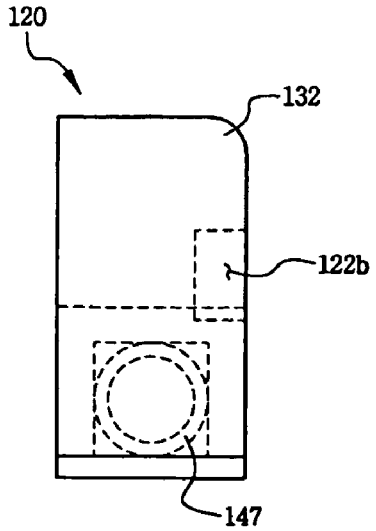

【Fig. 12】
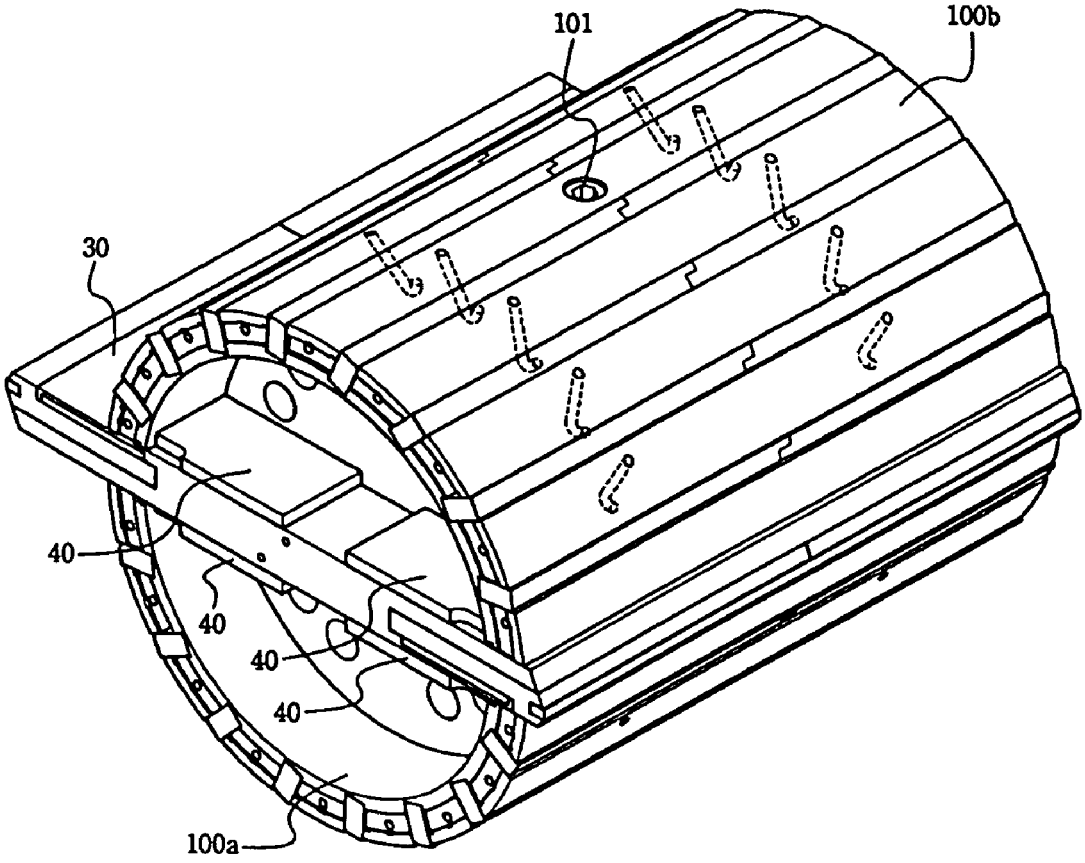

【Fig. 13】
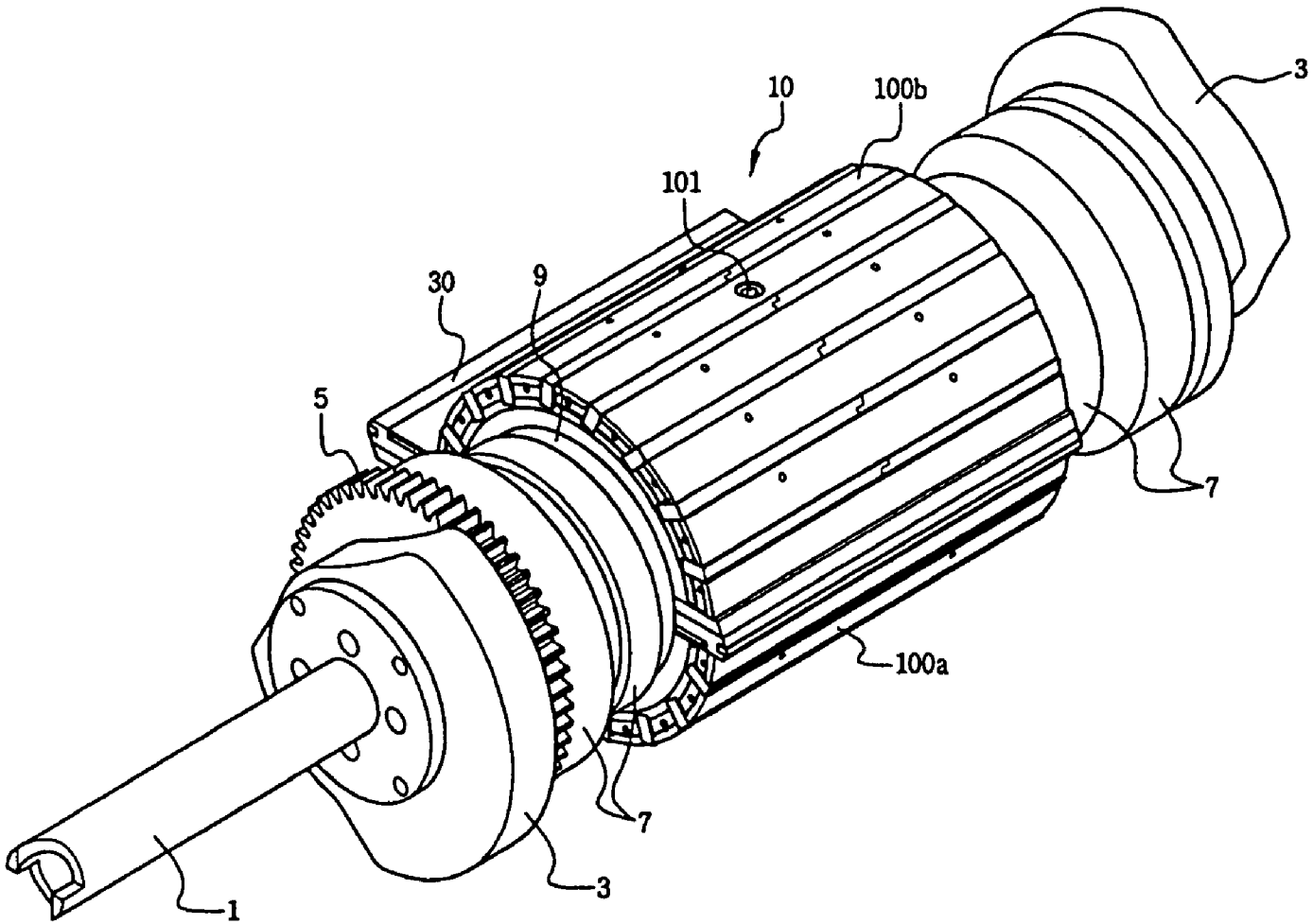

- PRIOR ART -
【Fig. 14】
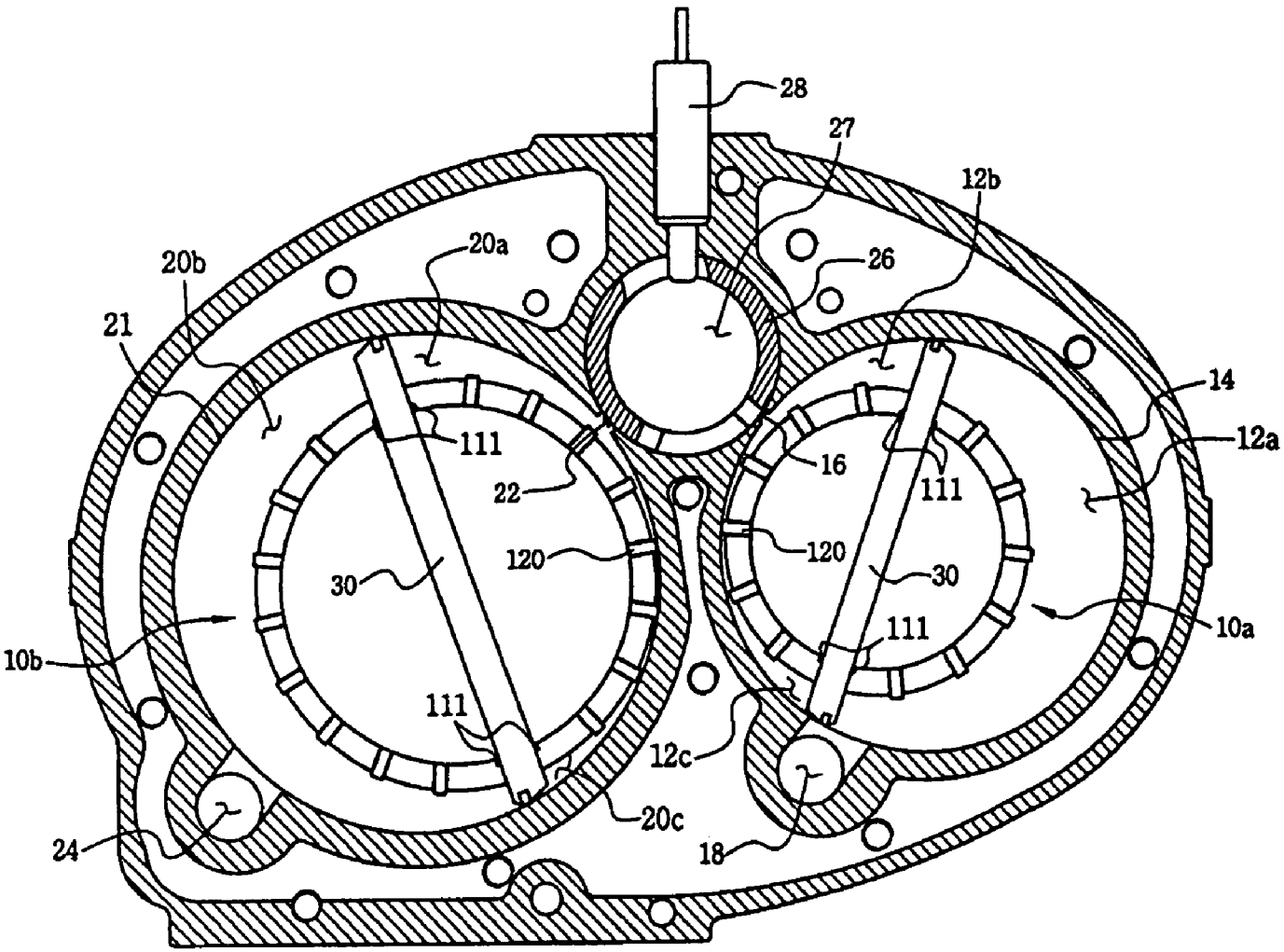

ROTOR ECCENTRICALLY INSTALLED IN A CYLINDER OF A ROTARY ENGINE OR COMPRESSOR

TECHNICAL FIELD

The present invention relates, in general, to rotors and, more particularly, to a rotor which is eccentrically installed in a cylinder of a rotary engine or a compressor and which includes a sliding vane that diametrically reciprocates and partitions the interior space of the cylinder while maintaining airtightness, thus compressing fuel/air mixture or air, or converting the explosive force of combustion gas into rotating force.

BACKGROUND ART

The inventor of the present invention proposed a rotary engine, which has an improved structure to solve the disadvantages experienced with conventional engines, such as wankel engines, etc., and was disclosed in Korean Patent Application No. 10-2005-20840 (Application Date: Mar., 14, 2005). The rotary engine of Korean Patent Application No. 10-2005-20840 comprises an engine body. The engine body includes a compression cylinder, which is configured to have a slightly distorted cylinder shape (an elliptical cylinder shape) and has at a predetermined position thereof an intake hole, through which fuel/air mixture or air is drawn into the compression cylinder. The engine body further includes an output cylinder, which has a slightly distorted cylinder shape (an elliptical cylinder shape) and is formed through the engine body in a direction parallel to the compression cylinder. A discharge hole, through which combustion gas is discharged, is formed at a predetermined position in the output cylinder. The engine body further includes a combustion chamber, which is formed between the compression cylinder and the output cylinder in a direction parallel both to the compression cylinder and to the output cylinder. The combustion chamber is divided into two cylindrical bores, which are symmetrical to each other, and each of which communicates with the compression cylinder through an intake gate and communicates with the output cylinder through a discharge gate. The rotary engine further comprises a compression rotor, which is eccentrically provided in the compression cylinder of the engine body and rotates such that fuel/air mixture or air is drawn into the compression cylinder through the intake hole, compressed, and supplied into the combustion chamber through the intake gates. The rotary engine further comprises an ignition device, which is provided in the combustion chamber of the engine body to ignite and explode the fuel/air mixture or air compressed and supplied by the compression rotor, and an output rotor which is eccentrically disposed in the output cylinder of the engine body and rotated using propulsive force generated by the combustion gas supplied from the compression cylinder through the discharge gates. The rotary engine further comprises a plurality of valves, which are provided in respective bores of the combustion chamber and control the intake gates and the discharge gates such that a compression process, a combustion process and an output process are sequentially conducted depending on rotational positions of the compression rotor and the output rotor. The rotary engine further comprises a synchronizing means, which rotates the compression rotor in conjunction with rotation of the output rotor, and an axial sealing means, which seals the compression cylinder, the combustion chamber and the output cylinder of the engine body. The present invention relates to a rotor for rotary engines or compressors which may be used as a compression rotor or an output rotor, which is a component of the rotary engine of Korean Patent Application No. 10-2005-20840.

Here, smooth diametrical sliding motion of the sliding vane is a critical requirement to ensure the practicability of Korean Patent Application No. 10-2005-20840.

If smooth diametrical reciprocation of the sliding vane, which crosses the central axis of the rotor that eccentrically rotates, is not realized, the compression process in the compression cylinder cannot be reliably conducted, and the explosive force of combustion gas in the output cylinder cannot be completely converted into rotating force. That is, smooth reciprocation of the sliding vane greatly affects the revolution speed, output power and efficiency of the rotary engine.

Airtightness is another essential requirement to ensure the practicability of Korean Patent Application No. 10-2005-20840. Particularly, it is very important to ensure air-tightness between the cylinders and the main bodies of the compression rotor and the output rotor, and airtightness between the main bodies of the compression rotor and the output rotor and the covers (in the case that a sealing plate is provided inside each cover, airtightness with sealing plates, and, hereinafter, both the cover and the sealing plate, are abbreviated as "cover").

It is also important to ensure airtightness between the inner surface of the compression cylinder and the sliding vane of the compression rotor, airtightness between the inner surface of the output cylinder and the sliding vane of the output rotor, and airtightness between the opposite side edges of the sliding vane and the covers, but means for achieving these will be declared in another patent to be filed by the inventor of the present invention.

Referring to the technique of Korean Patent Application No. 10-2005-20840 or referring to FIG. 14 of the present invention, the compression rotor and the output rotor of the rotary engine are eccentrically installed in respective cylinders, and the main body of each rotor rotates and contacts the inner surface of each cylinder. Here, airtightness between the main body of the rotor and the inner surface of the cylinder must be ensured in order to securely compress fuel/air mixture or air at high pressure in the compression chamber and to efficiently rotate the output rotor using high-pressure combustion gas in the output chamber.

Furthermore, it is very important to ensure airtightness between the covers and the main bodies of the compression rotor and the output rotor. If airtightness between the covers and the main bodies of the compression rotor and the output rotor is not ensured, in the compression cylinder, some high-pressure mixture or air may not be supplied from the compression cylinder into the combustion chamber but may leak into the main body of the compression rotor, and, in the output cylinder, some high-pressure combustion gas may not be used for rotating the output rotor due to leakage thereof into the main body of the output rotor. In this case, it is obvious that the efficiency of the rotary engine will be markedly reduced.

Furthermore, each of the main bodies of the compression rotor and the output rotor is divided into two body units, and the sliding vane is provided between the two body units. Here, because high-pressure gas may leak to a low-pressure side through a gap between the sliding vane and the body units if airtightness between the body units and the sliding vane is not ensured, it is also important to ensure airtightness between the body units and the sliding vane.

DISCLOSURE OF INVENTION

Technical Problem

Accordingly, the present invention has been made keeping in mind the above problems occurring in the prior art, and an object of the present invention is to provide a rotor which ensures smooth reciprocation of a sliding vane, thus increasing the efficiency of an engine.

Another object of the present invention is to provide a rotor which ensures airtightness between the main body and a cylinder in which the rotor is installed, thus increasing the efficiency of the engine.

A further object of the present invention is to provide a rotor which ensures airtightness between the opposite ends of the main body and a cylinder cover, thus increasing the efficiency of the engine.

Yet another object of the present invention is to provide a rotor which ensures airtightness between the outer surface of the sliding vane and body units constituting the main body, thus increasing the efficiency of the engine.

Technical Solution

In order to accomplish the above objects, the present invention provides a rotor, including: a first body unit, having a rotor housing having a hollow semi-cylindrical shape, a core having a solid semi-cylindrical shape and provided in the rotor housing, with a plurality of roller plate seats formed by depressing opposite sides of a planar surface of the core based on a partition wall axially provided on the planar surface of the core; a second body unit having a structure symmetrical with the first body unit; a roller support plate placed on each of the roller plate seats of the first and second body units and having a size corresponding to an area of the roller plate seat, with a stopper provided on each of axial opposite ends of the roller support plate; a roller cage provided between the stoppers of each of the roller support plates, with a pin roller receiving space formed through the roller cage; a plurality of pin rollers, each having a cylindrical shape in which a diameter thereof is less than a length thereof, the pin rollers being placed in the pin roller receiving space of the roller cage at positions adjacent to each other, so that, when a sliding vane reciprocates in a diametrical direction, the pin rollers roll between the roller support plate and the sliding vane; the sliding vane provided between the pin rollers of the first body unit and the pin rollers of the second body unit and reciprocating in the diametrical direction, with a spacer hole formed at a central position through the sliding vane and extending a predetermined length in the diametrical direction; and a spacer inserted into the spacer hole of the sliding bane and maintaining a distance between the first body unit and the second body unit.

Preferably, a plurality of sealing rod insertion slots, each of which extends in an axial direction and has a predetermined depth towards a central axis of the first and second body units, may be formed in a circumferential outer surface of each of the first and second body units. A plurality of pneumatic pressure guide holes may be formed in the circumferential outer surface of each of the first and second body units, such that each of the pneumatic pressure guide holes extends from a position defined adjacent to a corresponding sealing rod insertion slot on a circumferential outer surface of each of the first and second body units, to a bottom of each sealing rod insertion slot, so that high-pressure gas in a cylinder, in which the rotor is placed, is supplied into the bottoms of the sealing rod insertion slots through the pneumatic pressure guide holes. A sealing rod may be inserted into each of the sealing rod insertion slots and may be include: two rod pieces, with a spring insertion hole and an insertion notch formed in each of the rod pieces, and a first spring and a pressure leakage prevention member respectively inserted into the spring insertion hole and the insertion notch, so that high-pressure gas, which is supplied into the bottom of the related sealing rod insertion slot through the pneumatic pressure guide hole, pushes the sealing rod towards an inner surface of the cylinder while the pressure leakage prevention members prevent the high-pressure gas from leaking in the axial direction; and a second spring provided between the rod pieces of the sealing rod, thus pushing the rod pieces in axially opposite directions.

Furthermore, a sealing rail seating groove may be axially formed in each of junction surfaces of the rotor housings of the first and second body units between the rotor housings and the sliding vane. A sealing rail may be inserted into the rail seating groove. A third spring may be placed inside the sealing rail to push the sealing rail towards the sliding vane.

As well, a sealing member insertion notch, having a predetermined axial depth, may be formed at a position defined adjacent to each sealing rod insertion slot in semicircular edges of opposite ends of the first and second body units. A sealing member may be inserted into the sealing member insertion notch. A fourth spring may be provided in the sealing member, and a pneumatic pressure guide groove is formed in a side surface of the sealing member insertion notch such that high-pressure gas is drawn into the sealing member insertion notch through the pneumatic pressure guide groove, so that the sealing member is biased axially outwards both by the fourth spring and by the high-pressure gas.

ADVANTAGEOUS EFFECTS

In a rotor of the present invention, smooth reciprocation of a sliding vane is ensured even while the rotor rotates at high speed, and airtightness between the outer surface of the main body of the rotor and an inner surface of a cylinder of a rotor engine, between opposite ends of the main body of the rotor and cylinder covers, and between the sliding vane and the main body of the rotor is ensured. Therefore, the efficiency of the engine is markedly increased.

BRIEF DESCRIPTION OF THE DRAWINGS

FIG. 1 is an exploded perspective view showing a main body of a rotor, according to the present invention;

FIG. 2 is a partially exploded perspective view showing a first body unit of the main body of the rotor of FIG. 1;

FIG. 3 is a partially exploded perspective view showing a second body unit of the main body of the rotor of FIG. 1;

FIG. 4 is a perspective view showing a rotor housing and a core of the second body unit of FIG. 3, from which cover-side sealing members and cylinder-wall-side sealing rods have been removed;

FIG. 5 is a side view of FIG. 4;

FIG. 6 is a front view showing an embodiment of the sealing rod according to the present invention;

FIG. 7 is a bottom view of the sealing rod of FIG. 6;

FIG. 8 is a front view showing another embodiment of the sealing rod according to the present invention;

FIG. 9 is a bottom view of the sealing rod of FIG. 8

FIG. 10 is a side view of a modification of the sealing rod of FIG. 6;

FIG. 11 is a side view of another modification of the sealing rod of FIG. 6;

FIG. 12 is a perspective view showing the assembled main body of the rotor according to the present invention;

FIG. 13 is a perspective view showing the assembled rotor according to the present invention; and FIG. 14 is a view showing the usage of the rotor according to the present invention.

BEST MODE FOR CARRYING OUT THE INVENTION

Hereinafter, a rotor according to a preferred embodiment of the present invention will be described in detail with reference to the attached drawings.

FIG. 1 is an exploded perspective view showing a main body of a rotor, according to the present invention. FIG. 2 is a partially exploded perspective view showing a first body unit 100*a* of the main body of the rotor of FIG. 1. FIG. 3 is a partially exploded perspective view showing a second body unit 100*b* of the main body of the rotor of FIG. 1. FIG. 4 is a perspective view showing a rotor housing 102 and a core 104 of the second body unit 100*b* of FIG. 3, from which cover-side sealing members and cylinder-wall-side sealing rods 120 have been removed. FIG. 5 is a side view of FIG. 4. FIG. 6 is a front view showing an embodiment of the sealing rod 120. FIG. 7 is a bottom view of the sealing rod 120 of FIG. 6. FIG. 8 is a front view showing another embodiment of the sealing rod 120. FIG. 9 is a bottom view of the sealing rod 120 of FIG. 8. FIG. 10 is a side view of a modification of the sealing rod 120 of FIG. 6. FIG. 11 is a side view of another modification of the sealing rod 120 of FIG. 6. FIG. 12 is a perspective view showing the assembled main body of the rotor according to the present invention. FIG. 13 is a perspective view showing the assembled rotor according to the present invention. FIG. 14 is a view showing the usage of the rotor according to the present invention.

First, the usage of the rotors 10*a* and 10*b* according to the present invention will be explained herein below with reference to FIG. 14.

In the rotary engine shown in FIG. 14, an intake hole 18, through which mixture (air mixed with fuel) or air is drawn, and an intake gate 16, which communicates with a combustion chamber 27, are formed at predetermined positions in a compression cylinder 14. The compression rotor 10*a* rotates, thereby drawing fuel/air mixture or air into the compression cylinder 14 through the intake hole 18, compressing it, and supplying it into the combustion chamber 27 through the intake gate 16. Furthermore, in an output cylinder 21 of the rotary engine of FIG. 14, a discharge gate 22, through which high-pressure combustion gas is supplied from the combustion chamber 27 into the output cylinder 21, and a discharge hole 24, through which the combustion gas, having rotated the output rotor 10*b*, is discharged outside the engine, are formed. The output rotor 10*b* is rotated by the combustion gas, which has been ignited by an ignition device 28 in the combustion chamber 27. Furthermore, the output rotor 10*b* discharges combustion gas through the discharge hole 24 once every half-rotation thereof. Meanwhile, front and rear ends of the compression cylinder 14 and the output cylinder 21 are covered with covers (not shown), such that open opposite ends of a compression chamber 12*a*, 12*b* and 12*c* and an output chamber 20*a*, 20*b* and 20*c* are sealed by the covers. The construction of each cover was described in detail in the above-mentioned art disclosed in Korean Patent Application No. 10-2005-20840, therefore further explanation is deemed unnecessary.

As shown in FIG. 14, the compression rotor 10*a* and the output rotor 10*b* are provided in the respective compression cylinder 14 and the output cylinder 21 at positions eccentric in the direction of the combustion chamber 27. The main body of the compression rotor 10*a* and the main body of the output rotor 10*b* contact the respective inner surfaces of the compression cylinder 14 and the output cylinder 21 at positions eccentric towards each other. Furthermore, a sliding vane 30 is provided in each of the compression rotor 10*a* and the output rotor 10*b* and diametrically crosses the central axis of each rotor 10*a*, 10*b*. The sliding vane 30 rotates together with each rotor and, simultaneously, reciprocates in a diametrical direction.

Therefore, in a process of compressing and supplying fuel/air mixture or air into the combustion chamber 27 using rotation of the compression rotor 10*a*, the interior space of the compression cylinder 14 is divided into three sections 12*a*, 12*b* and 12*c*, other than the case in which the sliding vane 30 is in a horizontal position. Among the three sections 12*a*, 12*b* and 12*c*, the section 12*b*, in which fuel/air mixture or air is compressed at high pressure, is closed by a junction between the main body of the compression rotor 10*a* and the inner surface of the compression cylinder 14, a junction between an end of the sliding vane 30 and the inner surface of the compression cylinder 14, and junctions between the main body of the compression rotor 10*a* and the covers, other than the intake gate 16. Therefore, to compress fuel/air mixture or air, having been drawn into the compression cylinder 14 through the intake hole 18, at sufficiently high pressure, it is very important to ensure airtightness between the main body of the compression rotor 10*a* and the inner surface of the compression cylinder 14, airtightness between the main body of the compression rotor 10*a* and the cylinder covers, and airtightness between the sliding vane 30 and the inner surface of the compression cylinder 14.

Furthermore, in a process of rotating the output rotor 10*b* using explosive power of the high-pressure combustion gas discharged from the combustion chamber 27, the interior space of the output cylinder 21 is divided into three sections 20*a*, 20*b* and 20*c*, other than the case in which the sliding vane 30 is in a horizontal position. Among the three sections 20*a*, 20*b* and 20*c*, the section 20*a*, into which high-pressure combustion gas is supplied, is closed by a junction between the main body of the output rotor 10*b* and the inner surface of the output cylinder 21, a junction between an end of the sliding vane 30 and the inner surface of the output cylinder 21, and junctions between the main body of the output rotor 10*b* and the covers, other than the discharge gate 22. Therefore, in order to efficiently convert the explosive power of high-pressure combustion gas, which is supplied into the output cylinder 21 through the discharge gate 22, into rotating force, it is very important to ensure airtightness between the main body of the output rotor 10*b* and the inner surface of the output cylinder 21, between the main body of the output rotor 10*b* and the cylinder covers, and between the sliding vane 30 and the inner surface of the output cylinder 21.

If airtightness between the main bodies of the compression rotor 10*a* and the output rotor 10*b* and the outer surfaces of the vanes 30 is not ensured, because the high-pressure gas in the spaces 12*b* and 20*a* may leak into the low-pressure spaces 12*c* and 20*c*, thereby reducing the efficiency of the engine, it is also very important to ensure airtightness between the main bodies of the compression rotor 10*a* and the output rotor 10*b* and the outer surfaces of the sliding vanes 30.

In addition, each sliding vane 30 reciprocates once every rotation of each rotor 10*a*, 10*b*. Here, if smooth reciprocation of each sliding vane 30 is not realized, airtightness of the space 12*b* in which fuel/air mixture or air is compressed and the space 20*a* into which high-pressure combustion gas is supplied is not ensured and, moreover, the rotational load of each rotor 10*a*, 10*b* is increased, thus markedly reducing the efficiency of the engine.

Referring to FIG. 1, a special feature of the present invention resides in the fact that the main body of the rotor is divided into the first body unit 100*a* and the second body unit 100*b*, and the sliding vane 30 is provided between the first and second body units 100*a* and 100*b* so as to be reciprocable using rolling motion of pin rollers 46.

To achieve the above-mentioned purpose, the first body unit 100*a* includes a rotor housing 102, having a hollow semi-cylindrical shape, and a core 104, which has a solid semi-cylindrical shape and is provided in the rotor housing 102. A partition wall 110 is axially formed on a planar surface of the core 104 by cutting the opposite sides of the core 104, and roller plate seats 108 are formed on the cut opposite sides of the partition wall 110. A spacer 106 is provided at a medial position on the partition wall 110, so that, when assembled, the spacer 106 is inserted into a spacer insertion hole 32 of the sliding vane 30.

Furthermore, the second body unit 100*b* includes a rotor housing 102, which has a hollow semi-cylindrical shape and is symmetrical with the rotor housing 102 of the first body unit 100*a*, and a core 104, which has a semi-cylindrical shape and is installed in the rotor housing 102. Therefore, when the first and second body units 100*a* and 100*b* and the sliding vane 30 are assembled together, the main body of the rotor has a cylindrical shape, in which the cylindrical core is installed. On the planar surface of the core 104 of the second body unit 100*b*, roller plate seats 108 are formed by cutting opposite sides of a partition wall 110, which is axially disposed. The spacer 106, which is disposed on the partition wall of the first body unit 100*a*, is in contact with a medial portion of the partition wall 110 of the second body unit 100*b*.

Furthermore, a roller support plate 40, on which the pin rollers 46 smoothly roll, is placed on each roller plate seat 108 of the first and second body units 100*a* and 100*b*. Here, the pin rollers 46 may be directly placed on each roller plate seat 108, but it is preferable that the roller support plate 40, having surface hardness higher than that of the core 104 and superior lubricating ability, be provided to ensure smooth rolling motion of the pin rollers. Each roller support plate 40 has a size corresponding to the area of the roller plate seat 108. A stopper 41 is provided on each of axial opposite ends of the roller support plate 40, thus preventing the pin rollers 46 and a roller cage 42, which receives the pin rollers 46 therein, from being undesirably removed from the roller support plate 40.

The roller cage 42 is provided inside the stoppers 41 of each roller support plate 40 and has a plurality of pin roller receiving spaces 44 therein. Several pin rollers 46 are placed in each pin roller receiving space 44 of the roller cage 42. Each pin roller 46 has a cylindrical shape in which the diameter is less than the length thereof. Several pin rollers 46 are placed in each pin roller receiving space 44 such that they are adjacent to each other. Thus, when the sliding vane 30 reciprocates in diametrical directions, the pin rollers 46 conduct rolling motion between the roller support plates 40 and the sliding vane 30.

Each of the first and second body units 100*a* and 100*b* has the roller support plates 40, the roller cages 42 and the pin rollers 46, and the sliding vane 30 is interposed between the first and second body units 100*a* and 100*b*. Therefore, rolling motions of the pin rollers 46 are conducted on the opposite surfaces of the sliding vane 30.

The first and second body units 100*a* and 100*b* must maintain a predetermined distance therebetween in order to ensure smooth reciprocation of the sliding vane 30. To provide the predetermined distance between them, the spacer 106 is provided between the partition walls 110 of the first and second body units 100*a* and 100*b*. Furthermore, the spacer hole 32 is formed through a central portion of the sliding vane 30 and extends a predetermined length in a diametrical direction of the rotor. The spacer 106 is inserted into the spacer hole 32 of the sliding vane 30.

Thanks to the above-mentioned construction, in the rotor of the present invention, reciprocation of the sliding vane can be smoothly conducted even while the rotor rotates at a high speed.

Referring to FIGS. 2 through 5, another special feature of the rotor of the present invention resides in the fact that a cylinder-wall-side sealing means is provided on the outer surface of each of the first and second body units 100*a* and 100*b* and is in close contact with the inner surface of the cylinder in order to ensure airtightness therebetween, and a cover-side sealing means is provided on each of the opposite ends of the first and second body units 100*a* and 100*b* and is in close contact with the cylinder covers in order to ensure airtightness. Particularly, the rotor of the present invention is characterized in that the pressure of compressed mixture, the pressure of compressed air, or the pressure of combustion gas in the cylinder as well as the elasticity of springs is used as the sealing means.

In detail, to ensure airtightness between the inner surface of the cylinder and the circumferential outer surfaces of the first and second body units 100*a* and 100*b*; sealing rod insertion slots 118, each of which extends in an axial direction of the rotor and has a predetermined depth towards the central axis of the rotor, are formed around the circumferential outer surface of each of the first and second body units 100*a* and 100*b* at regular intervals. A cylinder-wall-side sealing rod 120 is inserted into each sealing rod insertion slot 118. Furthermore, pneumatic pressure guide holes 117 are formed in the main body of the rotor, each pneumatic pressure guide hole 117 extending from a respective position on the circumferential outer surface of the main body defined adjacent to a corresponding sealing rod insertion slot 118, to the bottom of each sealing rod insertion slot 118, such that high-pressure gas in the cylinder can be applied to the bottom of the pneumatic pressure guide holes 117. That is, in the circumferential outer surface of each of the first and second body units 100*a* and 100*b*, the sealing rod insertion slots 118, each of which extends in an axial direction of the body unit 100*a*, 100*b* and has a predetermined depth towards the central axis of the rotor, and the pneumatic pressure guide holes 117, which extend from positions on the circumferential outer surface of the main body between the sealing rod insertion slots to the bottom of the sealing rod insertion slots 118 such that high-pressure gas in the cylinder can be applied to the bottom of the pneumatic pressure guide holes 117, are formed. Furthermore, two rod pieces 122*a* and 122*b* constituting the cylinder-wall-side sealing rod 120 are inserted into the sealing rod insertion hole 118. Spring insertion holes 124 and insertion notches 126 for receiving pressure leakage prevention members are formed in an inner surface of each sealing rod 120. Springs 146 and pressure leakage prevention members 148 are respectively inserted into the spring insertion holes 124 and the insertion notches 126. Thus, high-pressure gas, which is supplied into the bottom of each sealing rod insertion slot 118 through the pneumatic pressure guide holes 117, pushes the sealing rod 120 towards the inner surface of the cylinder without leaking in an axial direction of the rotor. Furthermore, a separate spring 128 may be provided between the rod pieces 122*a* and 122*b* of each sealing rod 120, thus pushing the rod pieces 122*a* and 122*b* towards the cylinder covers.

As shown in FIG. 3, the pneumatic pressure guide holes 117 serve to guide high-pressure gas (fuel/air mixture, air or combustion gas) into the cylinder so that the gas can be used to ensure airtightness between the inner surface of the cylinder and the main body of the rotor. To easily form the pneumatic pressure guide hole 117 in the bottom of each sealing rod insertion slot 118, it is preferable that the sealing rod insertion slot 118 be formed such that it is angled with respect to the diametrical direction of the rotor. Each sealing rod 120, which is inserted into each sealing rod insertion slot 118, consists of two rod pieces 122*a* and 122*b*. An edge 132 of the sealing rod 120 protrudes outwards from the sealing rod insertion slot 118.

As shown in FIGS. 6 through 9, a spring 128 is provided between two rod pieces 122*a* and 122*b* constituting each sealing rod 120, so that the sealing rod 120, which is inserted into the sealing rod insertion slot 118, applies pushing force to the cylinder covers. Furthermore, when the sealing rod 120 is inserted into the sealing rod insertion slot 118, the springs 146, 147 are inserted into the sealing rod 120, so that the sealing rod 120 is pushed diametrically outwards by the springs 146, 147.

To place the springs 146 in the sealing rod 120, as shown in FIGS. 6 through 7, each spring insertion hole 124 and each insertion notch 126 are continuously formed in the sealing rod 120 in a diametrical direction. Thereafter, each spring 146 is fitted into each spring insertion hole 124 such that a part of the spring protrudes into the insertion notch 126. Subsequently, each pressure leakage prevention member 148 is inserted into each insertion notch 126. Alternatively, as show in FIGS. 8 and 9, each spring insertion hole 125 and each insertion notch 127 may be continuously formed in the sealing rod 120 in an axial direction. In this case, the insertion notch 127 is formed such that an outer side thereof is inclined. Springs 147 and pressure leakage prevention members 149 are respectively inserted into the spring insertion holes 125 and the insertion notches 127. Here, the pressure leakage prevention members 148, 149 serve to prevent high-pressure gas, which is drawn through the pneumatic pressure guide holes 117, from leaking in an axial direction while the high-pressure gas pushes the sealing rod 120 outwards.

As shown in FIGS. 2 through 5, the springs 146 or 128 are preferably coil springs, but not limited to coil springs. That is, any spring can be used, so long as it is able to provide elastic force to the sealing rod 120 such that the sealing rod 120 is pushed towards the inner surface of the cylinder or towards the covers of the cylinder.

FIGS. 10 and 11 show examples of the shape of the edge 132 of the sealing rod 120 which protrude outside when the sealing rod 120 is inserted into the insertion slot 118. Because only the edge 132 of each sealing rod 120 which protrudes outside the sealing rod 120 is in contact with the inner surface of the cylinder while the rotor is rotated, the protruding edge 132 is preferably rounded.

Furthermore, as shown in FIGS. 6 through 11, a key seating groove 130 is formed in a side surface of each sealing rod 120. As shown in FIG. 5, a key seating groove 115 is formed in a side surface of each sealing rod insertion slot 118 at a predetermined position corresponding to the key seating groove 130 of the sealing rod 120. While the sealing rod 120 is placed in the insertion slot 118, a rod-shaped key is loosely seated into the key seating grooves 130 and 115, thus preventing the sealing rod 120 from deviating from within a desired range despite being pushed by the springs 146. Thanks to the above-mentioned constriction, even though the springs 146, which are provided in the sealing rod 120, and high-pressure gas, which is supplied into the bottom of the insertion slot 118 through pneumatic pressure guide holes 117, push the sealing rod 120 diametrically outwards, the sealing rod 120 moves only slightly, and is prevented from being removed from the insertion slot 118.

Referring to FIGS. 2 through 14, a further special feature of the present invention resides in the fact that a sealing rail seating groove 105 is axially formed in each of junction surfaces of the rotor housings 102 between the sliding vane 30 and the rotor housings 102 of the first and second body units 100*a* and 100*b*, a sealing rail 111 is inserted into each rail seating groove 105, and a spring 113 is placed inside each sealing rail 111 to push it towards the sliding vane 30. Thanks to this construction, air-tightness between the sliding vane 30 and the first and second body units 100*a* and 100*b* is ensured.

Returning to FIGS. 2 through 5, in the rotor of the present invention, to ensure air-tightness between each cylinder cover and each of the semi-circular opposite edges of the first and second body units 100*a* and 100*b*, sealing member insertion notches 114, having a predetermined axial depth, are formed at positions adjacent to sealing rod insertion slots 118 in the semi-circular edges of the first and second body units 100*a* and 100*b* which contact the cylinder covers. A cover-side sealing member 150, which is biased towards the related cylinder cover, is inserted into each sealing member insertion notch 114.

In detail, the sealing member insertion notches 114 are formed along each semicircular edge of the first and second body units 100*a* and 100*b*, such that the notches 114 alternate with the sealing rod insertion slots 118. Furthermore, a spring 152 is provided inside each cover-side sealing member 150, which is inserted into each sealing member insertion notch 114. As well, a pneumatic pressure guide groove 116 is formed on a side surface of each sealing member insertion notch 114, so that high-pressure gas is drawn into the insertion notch 114 through the guide groove 116. As such, the present invention is characterized in that the cover-side sealing member 150 is pushed towards the cylinder cover both by the spring 152 and by the high-pressure gas. The sealing member insertion notches 114 are arranged so as to communicate with portions of the sealing rod insertion slots 118. Therefore, the side surfaces of the cover-side sealing members 150, which are inserted into the sealing member insertion notches 114, are in close contact with parts of the side surfaces of the cylinder-wall-side sealing rods 120, which are inserted into the sealing rod insertion slots 118. Preferably, grease or lubricant is applied to junction surfaces between the side surfaces of the cylinder-wall-side sealing rods 120 and the side surfaces of the cover-side sealing members 150, which are inserted into the sealing member insertion notches 114, thus preventing high-pressure gas from leaking.

FIG. 12 is a perspective view showing the assembled main body of the rotor of the present invention having the sliding vane reciprocation guide means, the cylinder-wall-side sealing means and the cover-side sealing means. As shown in FIG. 1, the first and second body units 100*a* and 100*b*, the sliding vane 30 and the spacer 106 are coupled together using a coupling bolt 101. For this, a tapped hole 109 is formed at a predetermined position in the first body unit 100*a*, and through holes 103 and 107 are respectively formed through the second body unit 100*b* and the spacer 106. Referring to FIG. 13, hubs 9 are coupled to respective opposite ends of the main body of the rotor of FIG. 12 by tightening taper pins or locking screws into locking holes 112, which are formed in the core 104 of the main body. Then, journals 7, a gear 5, a cam 3 and a rotor shaft can be added to the main body of the rotor of the present invention. The rotor, which has been assembled through the above-mentioned process, is used for rotary engines, as shown in FIG. 14.

INDUSTRIAL APPLICABILITY

As described above, the present invention provides a rotor in which smooth reciprocation of a sliding vane is ensured even while the rotor rotates at high speed, and airtightness between the outer surface of the main body of the rotor and an inner surface of a cylinder of a rotor engine, between opposite ends of the main body of the rotor and cylinder covers, and between the sliding vane and the main body of the rotor is ensured, thus maximizing the efficiency of the engine.

Although the preferred embodiment of the present invention has been disclosed for illustrative purposes, the scope of the present invention is not limited to the preferred embodiment. Furthermore, those skilled in the art will appreciate that various modifications, additions and substitutions are possible, without departing from the scope and spirit of the invention as disclosed in the accompanying claims. Therefore, it must be appreciated that the scope of the present invention is defined by the accompanying claims.

The invention claimed is:

1. A rotor, comprising:

a first body unit, comprising: a rotor housing having a hollow semi-cylindrical shape; a core having a solid semi cylindrical shape and provided in the rotor housing, with a plurality of roller plate seats formed by depressing opposite sides of a planar surface of the core based on a partition wall axially provided on the planar surface of the core;

a second body unit having a structure symmetrical with the first body unit;

a roller support plate placed on each of the roller plate seats of the first and second body units and having a size corresponding to an area of the roller plate seat, with a stopper provided on each of axial opposite ends of the roller support plate;

a roller cage provided between the stoppers of each of the roller support plates, with a pin roller receiving space formed through the roller cage;

a plurality of pin rollers, each having a cylindrical shape in which a diameter thereof is less than a length thereof, the pin rollers being placed in the pin roller receiving space of the roller cage at positions adjacent to each other, so that, when a sliding vane reciprocates in a diametrical direction, the pin rollers roll between the roller support plate and the sliding vane;

the sliding vane provided between the pin rollers of the first body unit and the pin rollers of the second body unit and reciprocating in the diametrical direction, with a spacer hole formed at a central position through the sliding vane and extending a predetermined length in the diametrical direction; and a spacer inserted into the spacer hole of the sliding vane and maintaining a distance between the first body unit and the second body unit.

2. The rotor according to claim 1, wherein a plurality of sealing rod insertion slots, each of which extends in an axial direction and has a predetermined depth towards a central axis of the first and second body units, is formed in a circumferential outer surface of each of the first and second body units, a plurality of pneumatic pressure guide holes is formed in the circumferential outer surface of each of the first and second body units, such that each of the pneumatic pressure guide holes extends from a position defined adjacent to a corresponding sealing rod insertion, slot on a circumferential outer surface of each of the first and second body units, to a bottom of each sealing rod insertion slot, so that high-pressure gas in a cylinder, in which the rotor is placed, is supplied into the bottoms of the sealing rod insertion slots through the pneumatic pressure guide holes, and a sealing rod is inserted into each of the sealing rod insertion slots and comprises: two rod pieces, with a spring insertion hole and an insertion notch formed in each of the rod pieces, and a first spring and a pressure leakage prevention member respectively inserted into the spring insertion hole and the insertion notch, so that high-pressure gas, which is supplied into the bottom of the related sealing rod insertion slot through the pneumatic pressure guide hole, pushes the sealing rod towards an inner surface of the cylinder while the pressure leakage prevention members prevent the high-pressure gas from leaking in the axial direction; and a second spring provided between the rod pieces of the sealing rod, thus pushing the rod pieces in axially opposite directions.

3. The rotor according to claim 1, wherein a sealing rail seating groove is axially formed in each of junction surfaces of the rotor housings of the first and second body units between the rotor housings and the sliding vane, a sealing rail is inserted into the rail seating groove, and a third spring is placed inside the sealing rail to push the sealing rail towards the sliding vane.

4. The rotor according to claim 1, wherein a sealing member insertion notch, having a predetermined axial depth, is formed at a position defined adjacent to each sealing rod insertion slot in semicircular edges of opposite ends of the first and second body units, a sealing member is inserted into the sealing member insertion notch, a fourth spring is provided in the sealing member, and a pneumatic pressure guide groove is formed in a side surface of the sealing member insertion notch such that high-pressure gas is drawn into the sealing member insertion notch through the pneumatic pressure guide groove, so that the sealing member is biased axially outwards both by the fourth spring and by the high-pressure gas.

* * * * *